US012349763B2

(12) United States Patent
Siddaiah et al.

(10) Patent No.: US 12,349,763 B2
(45) Date of Patent: Jul. 8, 2025

(54) MULTI-TEXTURE MICRO-MECHANICAL ACTUATION SYSTEM FOR IN SITU FRICTION CONTROL DURING HUMAN GAIT

(71) Applicant: Nevada Research & Innovation Corporation, Reno, NV (US)

(72) Inventors: Arpith Siddaiah, Reno, NV (US); Pradeep L. Menezes, Reno, NV (US)

(73) Assignee: Nevada Research & Innovation Corporation, Reno, NV (US)

( * ) Notice: Subject to any disclaimer, the term of this patent is extended or adjusted under 35 U.S.C. 154(b) by 292 days.

(21) Appl. No.: 17/917,879

(22) PCT Filed: Apr. 5, 2021

(86) PCT No.: PCT/US2021/025738
§ 371 (c)(1),
(2) Date: Oct. 7, 2022

(87) PCT Pub. No.: WO2021/207057
PCT Pub. Date: Oct. 14, 2021

(65) Prior Publication Data

US 2023/0119317 A1 Apr. 20, 2023

Related U.S. Application Data

(60) Provisional application No. 63/007,284, filed on Apr. 8, 2020.

(51) Int. Cl.
*A43B 13/26* (2006.01)
*A43C 15/16* (2006.01)

(52) U.S. Cl.
CPC ..... *A43B 13/26* (2013.01); *A43C 15/16* (2013.01); *A43C 15/161* (2013.01); *A43C 15/162* (2013.01)

(58) Field of Classification Search
CPC ..... A43B 13/26; A43C 15/16; A43C 15/161; A43C 15/162; A43C 15/165; A43C 15/06
(Continued)

(56) References Cited

U.S. PATENT DOCUMENTS 3,859,739 A * 1/1975 Dassler ..... A43C 15/162 36/67 D
3,898,751 A * 8/1975 Gustin ..... A43C 15/167 36/67 D (Continued)

OTHER PUBLICATIONS

International Search Report and Written Opinion, mailed Jul. 8, 2021, issued for International Patent Application No. PCT/US2021/025738, 10 pages.

*Primary Examiner* — Jocelyn Bravo
(74) *Attorney, Agent, or Firm* — Klarquist Sparkman, LLP

(57) ABSTRACT

An actuation system including a gear assembly, a plurality of friction members, an outsole for an article of footwear and an actuator. The gear assembly having a plurality of gears and each friction member being coupled to a respective gear of the gear assembly and having a series of textured outer surfaces. The outsole having an inner portion, an outer surface, and a plurality of openings extending from the inner portion to the outer surface, each opening being configured to receive one or more friction members such that at least one textured outer surface of each friction member is exposed on the outer surface of the outsole. The actuator is configured to rotate one or more gears of the gear assembly such that each friction member rotates relative to the outsole.

22 Claims, 12 Drawing Sheets

(58) Field of Classification Search
USPC ..... 36/59 R, 59 C, 62, 65, 67 R, 67 A
See application file for complete search history.

(56) References Cited

U.S. PATENT DOCUMENTS

| | | | | | |
|---|---|---|---|---|---|
| 4,233,759 | A * | 11/1980 | Bente | A43B 13/26 | 36/32 R |
| 5,259,129 | A * | 11/1993 | Deacon | A43B 5/001 | 36/62 |
| 5,367,793 | A * | 11/1994 | Deacon | A43C 15/162 | 36/134 |
| 5,557,865 | A * | 9/1996 | Sjosvard | A43C 15/14 | 36/134 |
| 5,836,092 | A | 11/1998 | Yarnell | | |
| 6,009,640 | A * | 1/2000 | Deacon | A43C 15/162 | 36/62 |
| 7,287,343 | B2 * | 10/2007 | Healy | A43B 13/223 | D2/908 |
| 2004/0040182 | A1 * | 3/2004 | McMullin | A43B 5/001 | 36/134 |
| 2005/0000118 | A1 * | 1/2005 | McMullin | A43C 15/162 | 36/134 |
| 2005/0081405 | A1 * | 4/2005 | Healy | A43B 13/223 | 36/59 C |
| 2005/0097782 | A1 * | 5/2005 | Mills | A43B 5/02 | 36/126 |
| 2007/0062070 | A1 * | 3/2007 | Kuhtz | A43B 1/0072 | 36/134 |
| 2007/0261271 | A1 | 11/2007 | Krouse | | |
| 2008/0016721 | A1 * | 1/2008 | Obeydani | A43C 15/14 | 36/61 |
| 2008/0196276 | A1 * | 8/2008 | McMullin | A43C 15/162 | 36/134 |
| 2010/0139129 | A1 * | 6/2010 | Kuhtz | A43C 15/162 | 36/67 A |
| 2011/0162235 | A1 * | 7/2011 | Bachmann | A43C 15/08 | 36/61 |
| 2011/0203136 | A1 * | 8/2011 | Auger | A43C 15/168 | 36/61 |
| 2012/0210608 | A1 * | 8/2012 | Baker | A43C 15/14 | 36/134 |
| 2013/0061498 | A1 * | 3/2013 | Droege | A43C 15/162 | 36/25 R |
| 2019/0298002 | A1 | 10/2019 | Chen et al. | | |

* cited by examiner

MULTI-TEXTURE MICRO-MECHANICAL ACTUATION SYSTEM FOR IN SITU FRICTION CONTROL DURING HUMAN GAIT

CROSS REFERENCE TO RELATED APPLICATIONS

This is the U.S. National Stage of International Application No. PCT/US2021/025738, filed Apr. 5, 2021, which was published in English under PCT Article 21(2), which in turn claims the benefit of U.S. Provisional Application No. 63/007,284, filed Apr. 8, 2020. The prior applications are incorporated herein in their entirety.

FIELD

The present disclosure relates to an actuation system for adapting an article of footwear to various ground conditions.

BACKGROUND

Millions of people globally are affected by some degree of visual impairment. Visual impairment can present several significant challenges to those effected, especially when walking within natural and built environments. Often, mobility aids are employed to assist those with some impairment to safely move about their immediate environment. However, the current state of technology in this area fails to adequately address the challenges varied ground surface conditions, such as ice, can pose when walking from one place to another. Sensors and the measurement of physical quantities can help provide much needed assistance in this regard. Electronic devices and algorithms, for instance, can use the sensor and measurement data to provide individuals useful information and help safely guide and assist individuals as they walk and interact within the immediate environment. By integrating such components with mobility products such as footwear, walking sticks, and other utilities, navigation is further enhanced for many, such as for the disabled and athletes. Thus, there is a need to further develop mobility products.

SUMMARY

According to an aspect of the disclosed technology, a representative embodiment of an actuation system includes a gear assembly, a plurality of friction members, an outsole for an article of footwear and an actuator. The gear assembly has a plurality of gears and each friction member being connected to a respective gear of the gear assembly and having a series of textured surfaces arranged circumferentially around the friction member. The outsole has an inner portion, an outer surface, and a plurality of openings extending from the inner portion to the outer surface, each opening receiving one or more of the friction members such that at least one of the textured surfaces of each friction member partially extends beyond or substantially lies within the plane of the outer surface. The actuator is configured to rotate one or more of the friction members such that each friction member and gear rotate relative to the outsole.

In another representative embodiment, an actuation system includes two or more gear assemblies, one or more crank assemblies, a plurality of friction members, an outsole for an article of footwear, and an actuator. Each gear assembly has a plurality of gears configured to interlock and rotate with one or more adjacent gears and each crank assembly has a series of shafts coupled to one another by a joint, wherein at least two of the two or more gear assemblies are connected to one another by one or more crank assemblies. Each friction member is connected to a respective gear of one of the two or more gear assemblies and has a series of textured surfaces arranged circumferentially around the friction member. The outsole has an inner portion, an outer surface, and a plurality of openings extending from the inner portion to the outer surface, each opening receiving one or more of the textual members such that at least one of the textured surfaces of each friction member partially extends beyond or substantially lies in a plane of the outer surface. The actuator configured to rotate one or more of the friction members such that each friction member and gear of the two or more gear assemblies rotate relative to the outsole.

In another representative embodiment, an actuation system includes a front gear assembly and a rear gear assembly, a crank assembly, a quantity of nine friction members, an outsole for footwear, and an actuator. Each gear assembly has four bevel gears configured to interlock and rotate with one or more adjacent bevel gears, wherein two of the four bevel gears lie along and rotate about a first axis and two of the bevel gears lie along and rotate about a second axis, wherein the first axis and the second axis are perpendicular. The crank assembly connects the front gear assembly and rear gear assembly, the crank assembly having a series of shafts pivotably coupled to one another by a joint. Each friction member has a hexagonal outer rim and a series of six textured surfaces arranged circumferentially around the hexagonal outer rim, each of the six textured surfaces corresponding to one of the six sides of the hexagonal outer rim; wherein five of the friction members are each connected to one of the gears of the front gear assembly and four of the friction members are each connected to one of the gears of the rear assembly. The outsole for footwear has an inner surface, an outer surface, and a plurality of openings extending from the inner surface to the outer surface, each opening receiving one or more of the friction members such that at least one of the textured surfaces of each friction member partially extends beyond or substantially lies in a plane of the outer surface. The actuator is configured to rotate one or more of the friction members connected to the rear gear assembly such that each of the nine friction members and each gear of the front gear assembly and rear gear assembly rotate.

The foregoing and other objects, features, and advantages of the technology will become more apparent from the following detailed description, which proceeds with reference to the accompanying figures.

DETAILED DESCRIPTION

General Considerations

Figure 1:
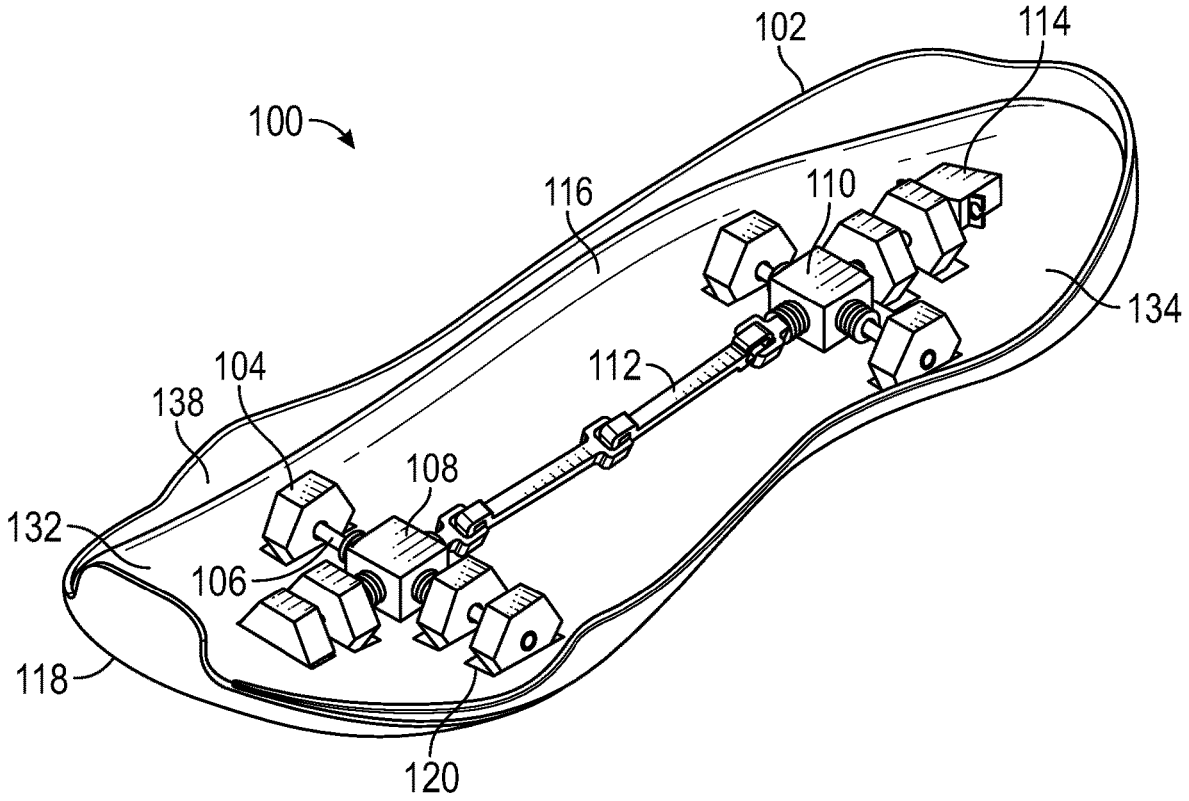
FIG. 1 is a perspective view of an actuation system.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. Any theories of operation are to facilitate explanation, but the disclosed systems, methods, and apparatus are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses the terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or apparatus are referred to as "lowest," "best," "minimum," or the like. It will be appreciated that such descriptions are intended to indicate that a selection among many used functional alternatives can be made, and such selections need not be better, smaller, or otherwise preferable to other selections.

As used in the application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside," "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Examples of the Disclosed Technology

The integration of mobility products and technology is becoming increasingly important to individuals with a visual impairment, as it helps those effected to navigate their immediate environment. The integration of technology and footwear, for instance, not only can assist the visually impaired move about their environment, it can augment the interaction between those with less severe or no impairment experience and the natural and build environment, such as to direct or assist firefighters in situations of low visibility or help runners and athletes generally achieve greater performance. Described herein is an actuation system that can be used in conjunction with a friction control system to provide variable traction control for footwear.

FIG. 1 shows an exemplary actuation system 100 configured to adjust the outsole traction of an article of footwear to various ground conditions to provide a user with more traction as they walk and/or run about natural and built environments. Stated another way, the actuation system 100 is configured to adjust or control the variable friction between the outsole of footwear and the immediate ground surface during the gait cycle of the user based on the characteristics of the ground surface, such as whether the surface is rough or smooth and/or hard or soft.

As shown in FIG. 1, the actuation system 100 can include an outsole 102 for an article of footwear, one or more friction members 104, one or more axles 106, a front gear assembly 108, a rear gear assembly 110, a crank assembly 112, and an actuator 114. As described herein, the friction members 104 can be rotated via the actuator 114 based on output from one or more sensors, measurement units, and/or system controls during the stance and swing gait phases of the user. For instance, during the swing phase of the user, the actuator 114 can be directed to apply a rotational force such that the axles 106, crank assembly 112, and gears 166 (FIG. 11) of the front and rear gear assemblies 108, 110 rotate one or more of the friction members 104. Via textured surfaces along the outer surface of the friction members 104, this rotation of the friction members 104 can provide the variable friction between the outsole 102 and ground surfaces, such as to increase the outsole traction on slick and/or wet surfaces, based on output from one or more sensors and/or measurement units.

FIG. 1 shows the outsole 102 of the actuation system 100 can house the other components of the actuation system 100 such that the friction members 104, actuator 114, axles 106, and gear assemblies 108, 110, are contained entirely or partially within the outsole 102. The outsole 102 includes an inner portion 116 (or alternatively an inner surface), an outer surface 118, and a plurality of openings 120 extending between the inner portion 116 and the outer surface 118. Each opening 120 of the outsole 102 for instance, is sized and shaped to receive a respective friction member 104 and to allow the friction member 104 to rotate within the space created by the opening. In this configuration, the outsole 102 can be of any desired thickness and still accommodate the friction members 104 and their rotation. Although each opening 120 in FIG. 1 is shown as receiving a single friction member 104, in other embodiments, each opening can be sized and shaped to receive two or more friction members 104.

Figure 3:
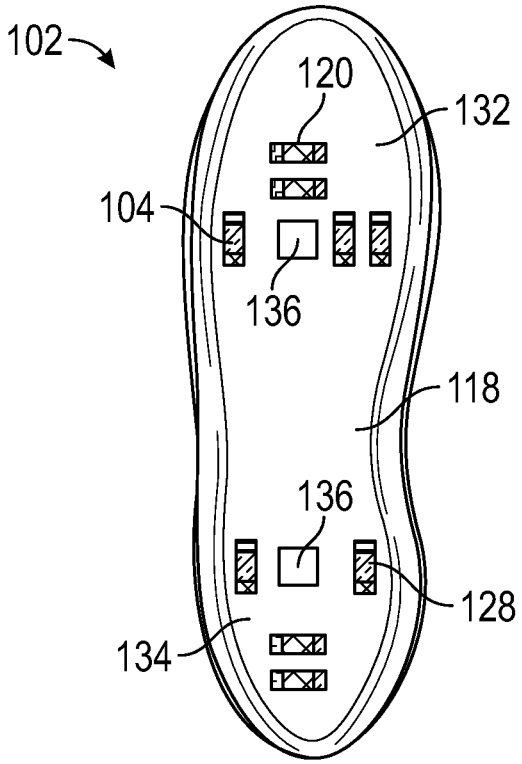
FIG. 3 is a bottom view of the actuation system attached to or integrated with an article of footwear.
Figure 4:
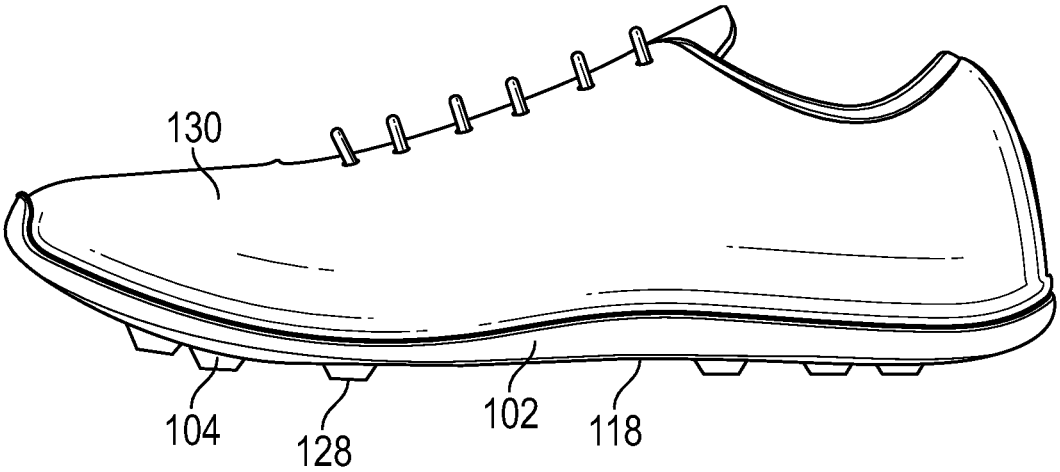
FIG. 4 is a side view of the actuation system and article of footwear of FIG. 3.

As shown in FIGS. 1 and 3-4, a portion of one or more friction members 104 can extend through a respective opening 120 and lie beyond and/or within the plane of the outer surface 118 of the outsole 102 of an article of footwear 130. This positioning of the friction members 104 can, for example, ensure that each friction member 104 and textured surfaces thereof, are located within a plane of the outer surface 118 and configured to contact the ground surface.

Figure 2:
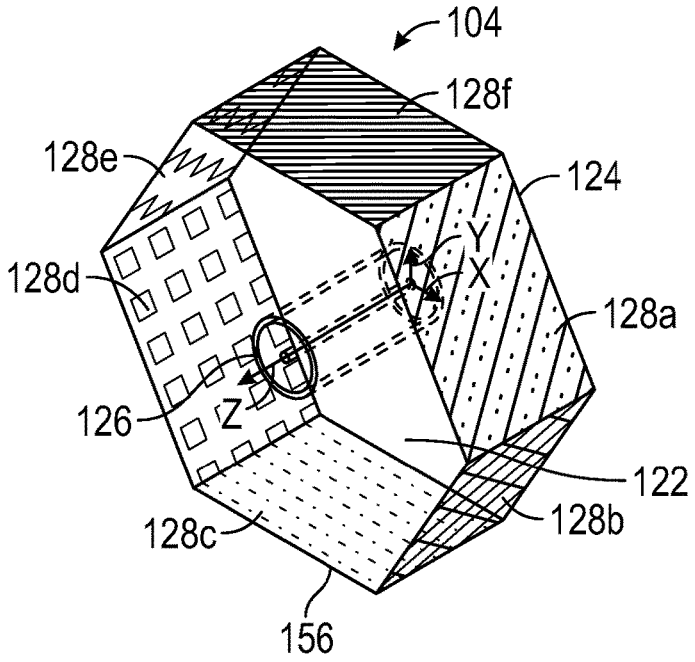
FIG. 2 is a perspective and semi-transparent view of a friction member of the actuation system.
Figure 14:
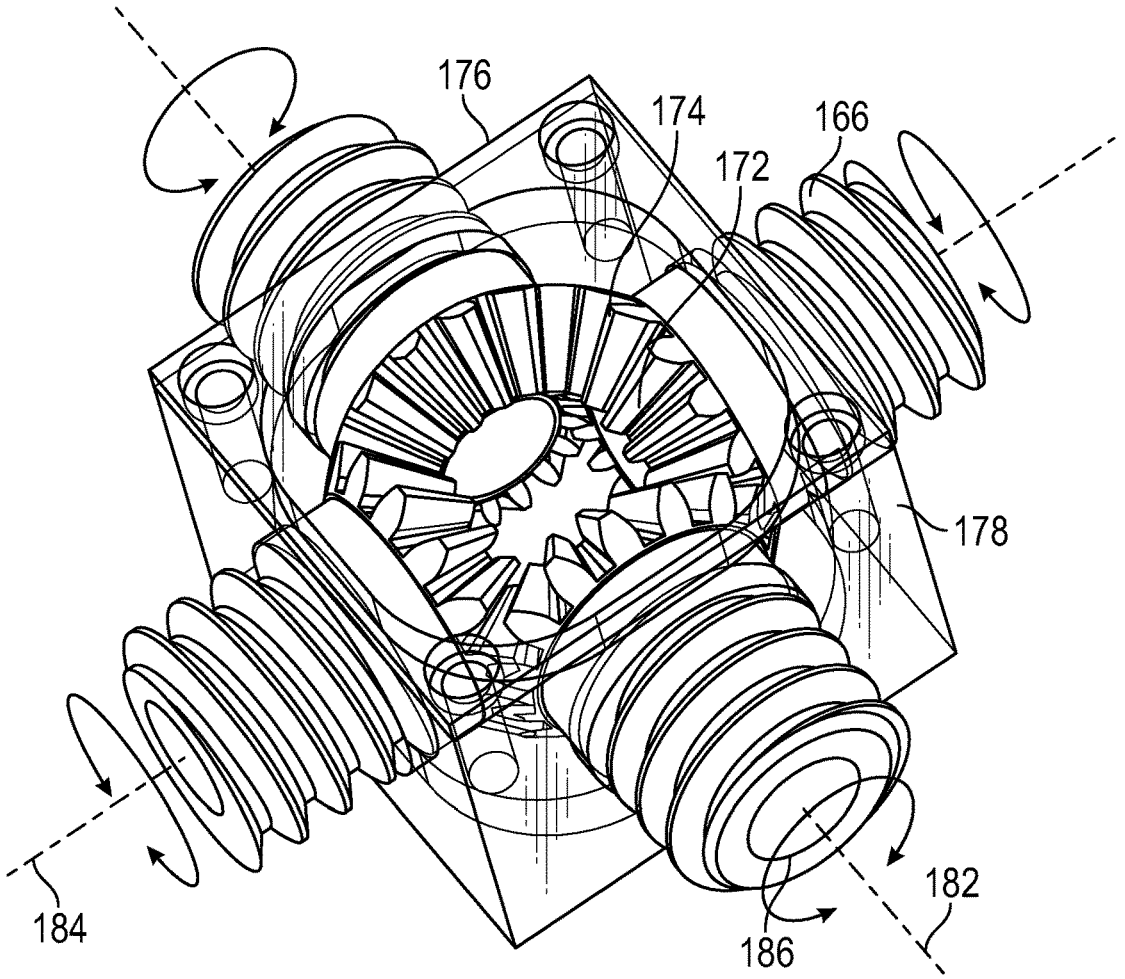
FIG. 14 is a perspective and semi-transparent view of the gear assembly of the actuation system.
Figure 15:
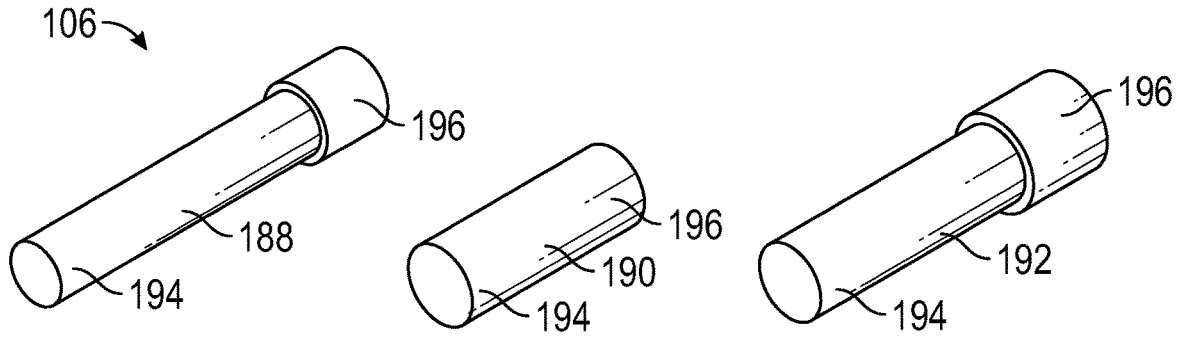
FIG. 15 is a perspective view of three axles for coupling the friction members to the gear assembly.
Figure 16:
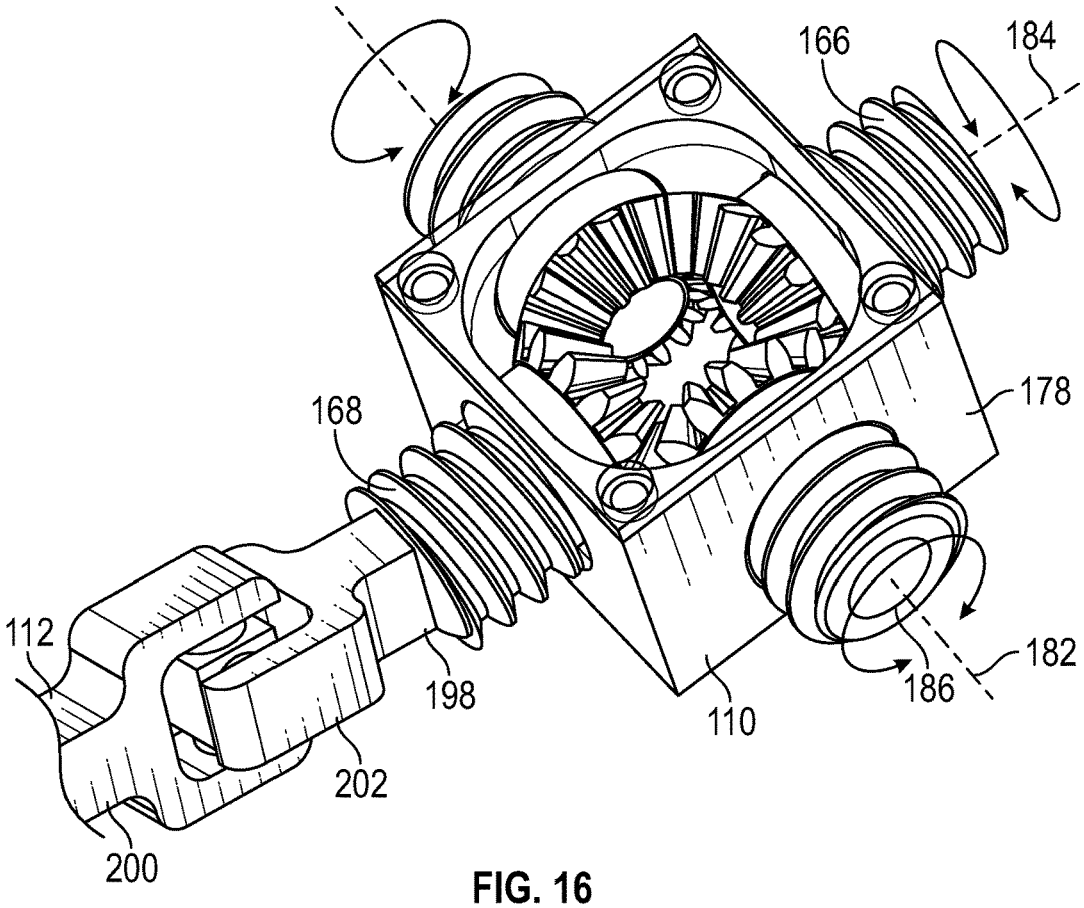
FIG. 16 is a perspective view of the gear assembly of FIG. 14 and a crank assembly of the actuation system.

As depicted in FIG. 2, each friction member 104 can be wheel- or disk-like in shape and include a first side surface 122, a second side surface 124, and a central opening 126 extending between the first and second side surfaces 122, 124. The central opening 126 of each friction member 104 can be configured to receive and mount to one or more axles 106 of the actuation system 100 in such a way as to cause the friction member 104 to rotate as its respective axle 106 and gear assembly 108, 110 rotate (FIG. 14-16).

Each friction member 104 can also include a series of textured surfaces 128*a-f* along its outer surface, such as its circumference and/or outer edge. For instance, as illustrated in FIG. 2, the friction members 104 can be hexagonal in shape and thereby have six sides along its outer surface/edge. Each of the six sides of the hexagonal shape of the friction member 104 can correspond to a single textured surface within the series of textured surfaces 128*a-f*. Each of the textured surfaces 128*a-f* can, for example, have a design pattern that is distinct from the design pattern of each of the other textured surfaces and configured to provide some degree of outsole traction different than that of the other textured surfaces 128*a-f* (e.g., Table 1). In this way, the textured surfaces 128*a-f* can be configured to provide discrete and/or overlapping levels of friction between the outsole 102 and ground surface to increase and/or decrease outsole traction for six different ground conditions or situations (Table 1). In other words, each textured surface 128*a-f* of a friction member 104 can correspond to a separate ground condition.

In some instances, the amount of friction a particular textured surface 128*a-f* provides, corresponds with a coefficient of friction. As such, each friction member 104 can provide varied degrees of friction across a range of friction coefficients. As one example, Table 1 shows that each textured surface 128*a-f* within the series can have different and/or overlapping coefficient of friction with that of one or more other textured surfaces.

TABLE 1

| Textures | Ground Conditions | Coefficient of Friction |
|---|---|---|
| a | Oil | 0.30-0.45 |
| b | Water | 0.40-0.65 |

TABLE 1-continued

| Textures | Ground Conditions | Coefficient of Friction |
|---|---|---|
| c | Fine dust or no contaminants | 0.70-0.90 |
| d | Ice | 0.09-0.15 |
| e | Ice and water mixture | 0.20-0.30 |
| f | Snow | 0.30-0.45 |

Although the coefficients of friction listed have specified numerical values, it should be understood that the textured surfaces 128 of the friction members 104 can be configured to provide any single or range of coefficients not listed in Table 1 and across any number of textured surfaces and ground conditions.

Though the friction members 104 are described herein as being hexagonal in shape, it should be appreciated that the friction members 104 can be formed in a variety of geometric shapes, including but not limited to, a pentagon, heptagon, octagon, nonagon, decagon, circle, oval, square, triangle, etc. Accordingly, each friction member 104 can have a number of textured surfaces equal to the number of sides of its corresponding shape (e.g., FIG. 2). Nonetheless, in some embodiments, the friction members can have a number of textured surfaces greater than or less than the number of sides of its corresponding shape.

As mentioned, each textured surface 128 can have a design pattern distinct from the design pattern each of the other textured surfaces and configured to provide some degree of outsole traction different than that of the other textured surfaces. Yet, in other embodiments, the series of textured surfaces 128 can have two or more textured surfaces repeated and arranged around the outer edge of the friction member 104. By way of example, the hexagonal shaped friction member 104 of FIG. 2, can have two different textured surfaces, each with distinct design patterns and coefficients of friction such that three textured surfaces have one configuration and the three remaining textured surfaces have another configuration. In such examples, the two textured surfaces can be arranged in an alternating pattern or sequence along the outer circumference/edge of the friction member. In this manner, the rotation of the friction member 104 need only be slight (e.g., in either a clockwise or counterclockwise direction) to change the textured surface 128 from one configuration to another.

The friction members 104 and the textured surfaces 128 thereof can be constructed of various rigid and/or flexible materials, including but not limited to, metals, polymers, open- and/or closed-cell foam, and/or other suitable materials. In some embodiments, the series of textured surfaces 128 and/or the first and second side surfaces 122, 124 of the friction members 104 are constructed of different materials. For example, the textured surfaces 128 can be made of a relatively rigid material, and the side surfaces 122, 124 and body of friction member 104 can be made of a relatively soft, flexible material. In such configurations, for example, the textured surfaces 128 can hold their form and ensure proper friction is sustained over long periods of use, while the body and side surfaces 122, 124 can provide padding or cushioning in a similar manner as the surrounding outsole 102 and/or other sole portions of the footwear. In some embodiments, the friction members 104 can be constructed of varying grades of polyurethane material and/or include embedded threads to form the textured surfaces 128*a-f*. In other embodiments, the friction members 104 can be fabricated from light-weight materials such as aluminum alloys and/or 3-D printed materials, such polymers or other carbon materials.

Turning now to FIGS. 3-6, the openings 120 can be arranged and formed within the outsole 102 to accommodate any number of configurations of the actuation system 100 and footwear designs. For instance, the illustrated embodiments show the outsole 102 can include five openings 120 located within a front portion 132 (e.g., proximate the toe of the footwear 130) and four openings 120 located within a rear portion 134 (e.g., proximate the heel of the footwear 130). In this arrangement, the outsole 102 can accommodate the nine friction members 104 depicted in FIGS. 1, 3, and 11, each opening 120 corresponding to a respective friction member 104.

The openings 120 can also be arranged and configured to provide a greater number of friction members 104 and/or a greater surface area of textured surfaces 128. This, among other things, can provide increased (or decreased) traction over portions of the outsole 102 generally having more surface area in contact with the ground surface, such as below the toes and ball of the user's feet. In the same manner, the arrangement and configuration of the openings 120 can accommodate a fewer number of friction members 104 and/or a smaller surface area of textured surfaces for those portions of the outsole 102 where variable friction control may be undesirable. In still further configurations, the openings 120 can accommodate consecutive friction members 104 (e.g., two consecutive openings 120 at the toes, ball, and heal of the outsole 102) and/or to accommodate the size, structure, and conditions of the user's foot (e.g., shoe size, abnormalities, etc.).

In some embodiments, one or more of the openings within the outsole 102 can be configured as assembly openings 136, sized and shaped to receive and provide access to one or more components of the actuation system 100. For example, the assembly openings 136 can allow for external access to the front and rear gear assemblies 108, 110 and/or the actuator 114 through the outer surface 118, such as for repair or replacement.

Figure 11:
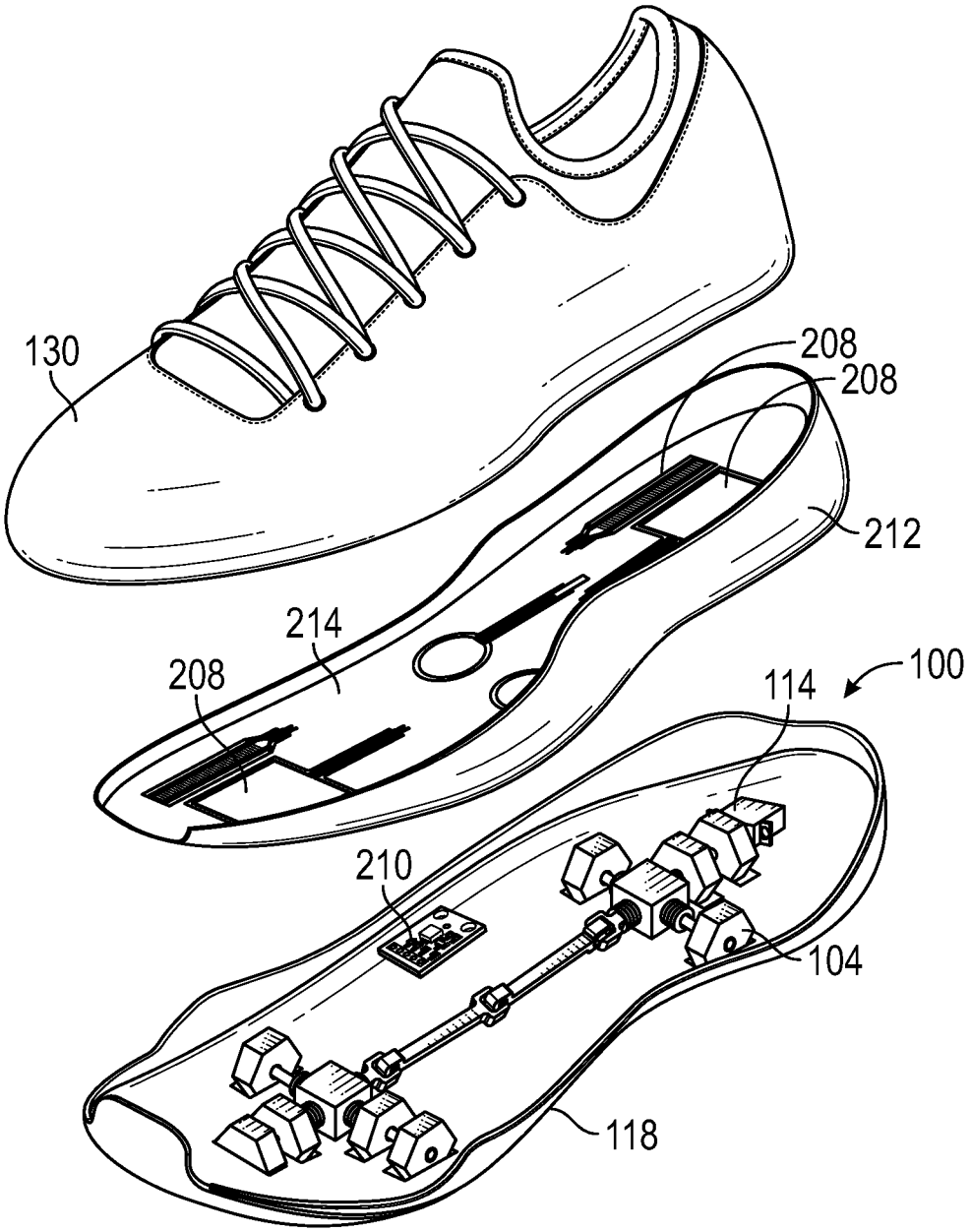
FIG. 11 is an exploded view of an article of footwear including the actuation system and the midsole of FIG. 10.

As shown in FIGS. 1 and 4, the outsole 102 and the actuation system 100 generally, can be configured to attach to a premanufactured article of footwear (FIG. 1) or be an integrated portion of an article footwear (FIGS. 4 and 11). For instance, as depicted in FIG. 1, the outsole 102 can have a lip 138 extending upwardly (or substantially upwardly) from the outer edge of the inner portion 116 and/or outer surface 118 to form a snap-fit attachment for footwear. In this configuration, the lip 138 can be positioned along the outer surface of the footwear's sole such that the lip 138 engages and applies a force against the sole to secure the outsole 102 of the actuation system 100 to the piece of footwear. Alternatively and as illustrated in FIGS. 4 and 11, the outsole 102 and actuation system 100 can be fully integrated within the sole of the footwear 130.

In some embodiments, the outsole 102 can be secured to an article of footwear in a variety of other ways, such as by a snap button, adhesives, straps, screws, pins, hook-and-loops, etc. For example, the outsole 102 can be secured to the article of footwear 130 by a snap-button strap 139 (FIG. 8) alone and/or in combination with the lip 138.

The outsole 102 can be constructed from a variety of materials, including, but not limited to leather, synthetic rubber, natural rubber, polyurethane, polyvinyl chloride (PVC), polymers, and/or other materials. The outsole 102 can also be constructed to be waterproof, water resistant, and/or to be entirely submerged within a liquid and/or semi-solid substance. Though an outsole is used herein to describe the actuation system 100, the same principles and features of the present disclosure can be applied to various portions of footwear, including but not limited to, the insole, heel counter support, heel wedge, midsole, etc.

Figure 7:
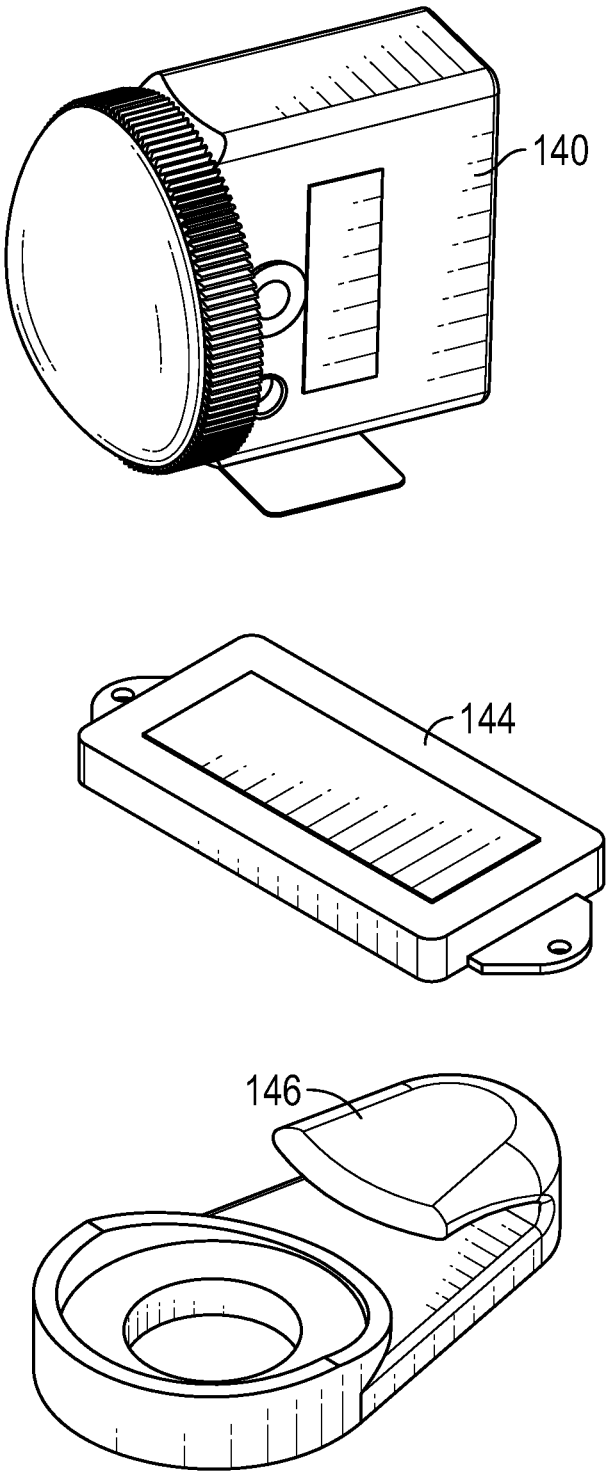
FIG. 7 shows a perspective view of a sensor, a measurement unit, and a sensor mount which can be used with the actuation system.
Figure 8:
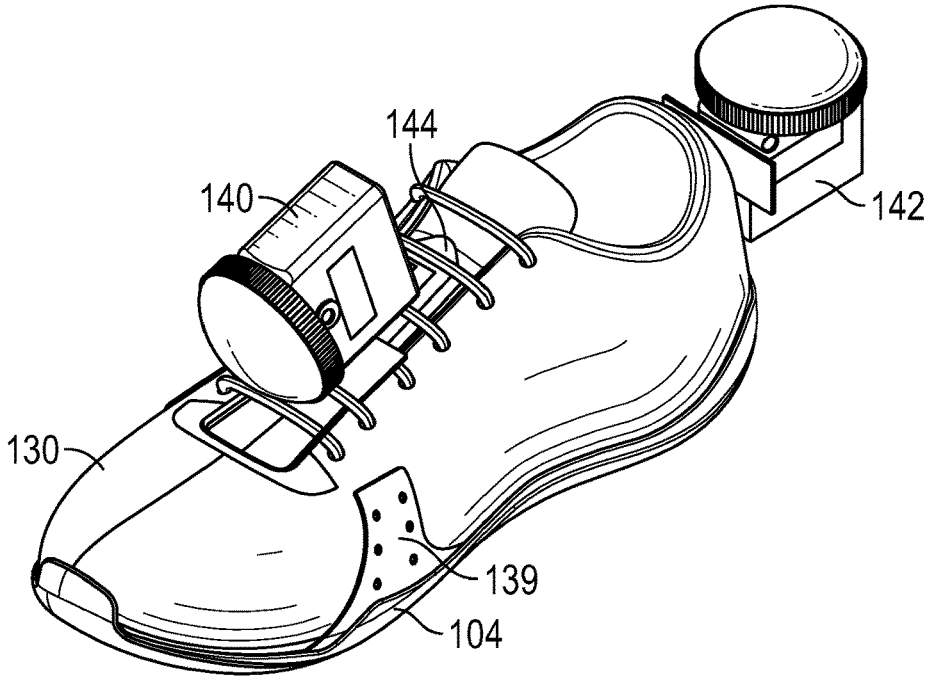
FIG. 8 is a perspective view of the sensors of FIG. 7 mounted to an article of footwear.
Figure 9:
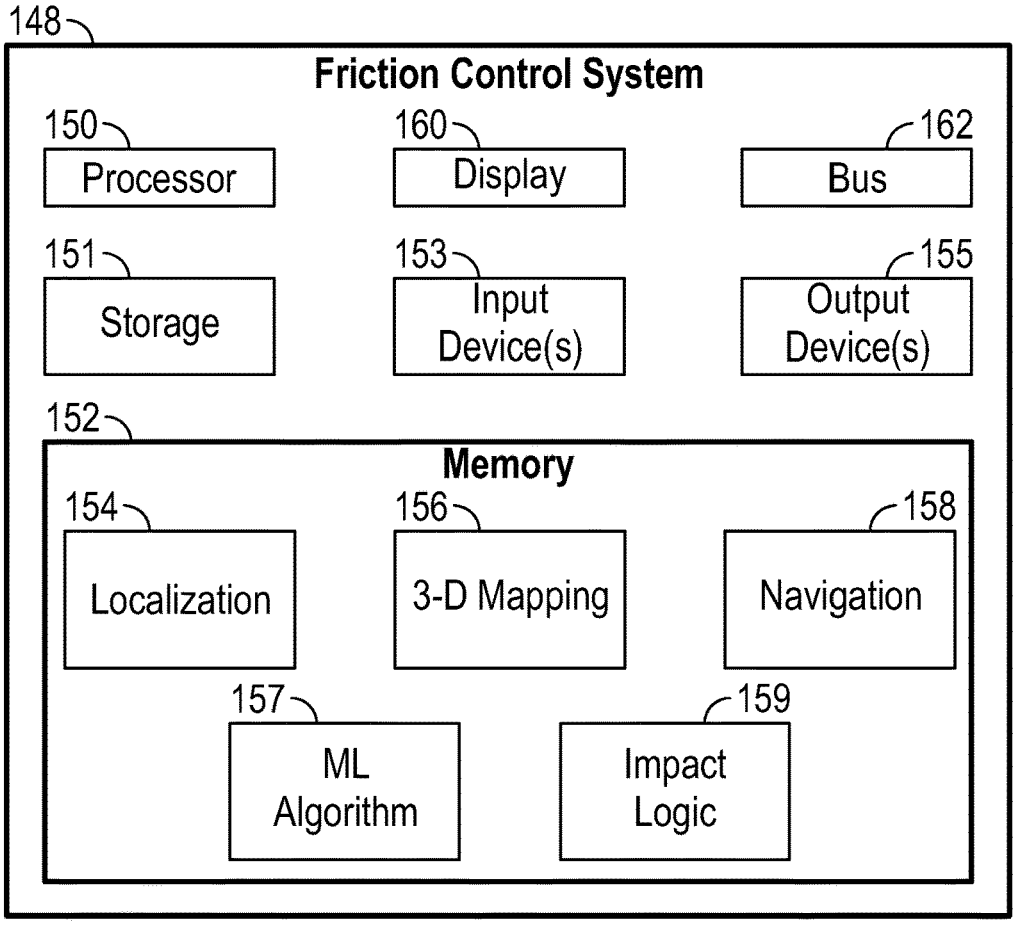
FIG. 9 is a block diagram of a friction control system for implementing embodiments of the disclosed technology.

Referring now to FIGS. 7-9, according to one embodiment, the rotation (e.g., actuation) of the friction members 104 by actuator 114 can be based on real-time (or stored) data that is output by one or more sensors 140, 142 and/or measurement units 144 to a friction control system 148. As shown in FIGS. 7 and 8, the sensors 140, 142 can be 2-D laser range scanners mounted to the front and rear of an article of footwear 130 to scan the surrounding environment. The front sensor 140 can be mounted to, for instance, the front of the footwear 130 via a mount 146 coupled to the laces, tongue, and/or upper portion of the footwear generally. Moreover, the measurement unit 144 can be mounted, for example, to the footwear 130 via the mount 146 and/or sensor 140 and can be an inertial measurement unit (IMU) to help localize motion readings of the user's foot during the gait phases.

Accordingly, the sensors 140, 142 and measurement unit 144 can output data to the friction control system 148 where localization 154, 3D mapping 156, navigation 158, and/or machine learning algorithms 157, use the data to map the immediate surroundings, determine ground conditions (e.g., ice, oil, dust, etc.), and/or direct the actuation system 100 to rotate the plurality of the friction members 104. In this manner, the sensors 140, 142, measurement unit 144, and actuation system 100 exploit the gait phases of human foot motion to adjust the article of footwear to various ground conditions to assist the user in navigating and experiencing the surrounding environment (e.g., for the visually impaired and/or athletes).

FIG. 9 is schematic block diagram of a friction control system 148 capable of implementing the embodiments described herein. The illustrated friction control system 148 can be a computing device which can be remote and/or integrated into footwear with the actuation system 100 and includes a controller or processor 150 and a memory 152. Computing devices can include desktop or laptop computers, mobile devices, tablets, programmable logic controllers (PLCs), microcontrollers, systems-on-a-chip, or the like. The processor 150 can include one or more CPUs, GPUs, ASICs, FPGAs, MCUs, PLDs, CPLDs, etc., that can perform various data processing, signal coding, power control, and/or I/O functions associated with actuation system 100. The memory 152 can be volatile or non-volatile (e.g. RAM, ROM, flash, hard drive, optical disk, etc.) and/or non-removable or removable. The memory 152 can provide storage for various processor-executable logic instructions and program modules which when executed by the processor 150, cause the actuation system 100 to rotate and/or fix the friction members 104, such as by the algorithms 154-158 and/or impact logic 159. Storage 151 can also be provided with one or more other computer-readable media.

The friction control system 148 can also include additional features. For example, the friction control system 148 can include one or more input devices 153, one or more output devices 155, and one or more system buses 160 to provide a communication path between various environment components, such as between processor and I/O communication modules. The friction control system 148 can also be situated in a distributed form so that applications and tasks are performed by remote processing devices that are linked through a communications network. In a distributed computing environment, program modules and logic can be located in both local and remote memory storage devices. In further embodiments, system parameters or performance outputs can be displayed on a display 162 and can be controlled by one or more input/output devices 153, 155 and/or operator (e.g., with a keyboard, mouse, or other interactive device, including the display 162).

In some configurations, the sensors 140, 142 and measurement unit 144 can communicate the environmental data and user gait status to the friction control system 148. This input data can then be used by the friction control system 148 to run the input data through a machine learning algorithm 157 and/or algorithms 154-158 to identify the environment and ground conditions to determine whether to rotate the friction members 104. As one example, a machine learning algorithm 157 can be trained to analyze the input data and/or data from the other algorithms to identify a variety of floor conditions which it then uses to determine whether one or more of the friction members 104 should be rotated, such as when user's foot is transitioning from water to ice. If the machine learning algorithm 157 determines that the friction members 104 should rotate, the friction control system 148 can provide a rotation angle for the desired textured surface 128 and direct the actuator 114 to rotate (e.g., the actuator configured as an output device 155). The resulting actuation rotates one or more friction members 104 to the desired textured surface 128 such that the textured surface 128 is exposed along the outer surface 118 of the outsole 102 and can make contact with the ground surface to provide the determined increase or decrease in friction/traction, such as to reduce the likelihood of slippage or fall.

Further details regarding how sensors and IMUs produce and provide real-time data for real-time human foot localization and 3D mapping during the foot motion of the user are described in L. V. Nguyen, et al. *A Smart Shoe for building a real-time 3d map*, Automation in Construction (2016), which is incorporated herein by reference.

Figure 10:
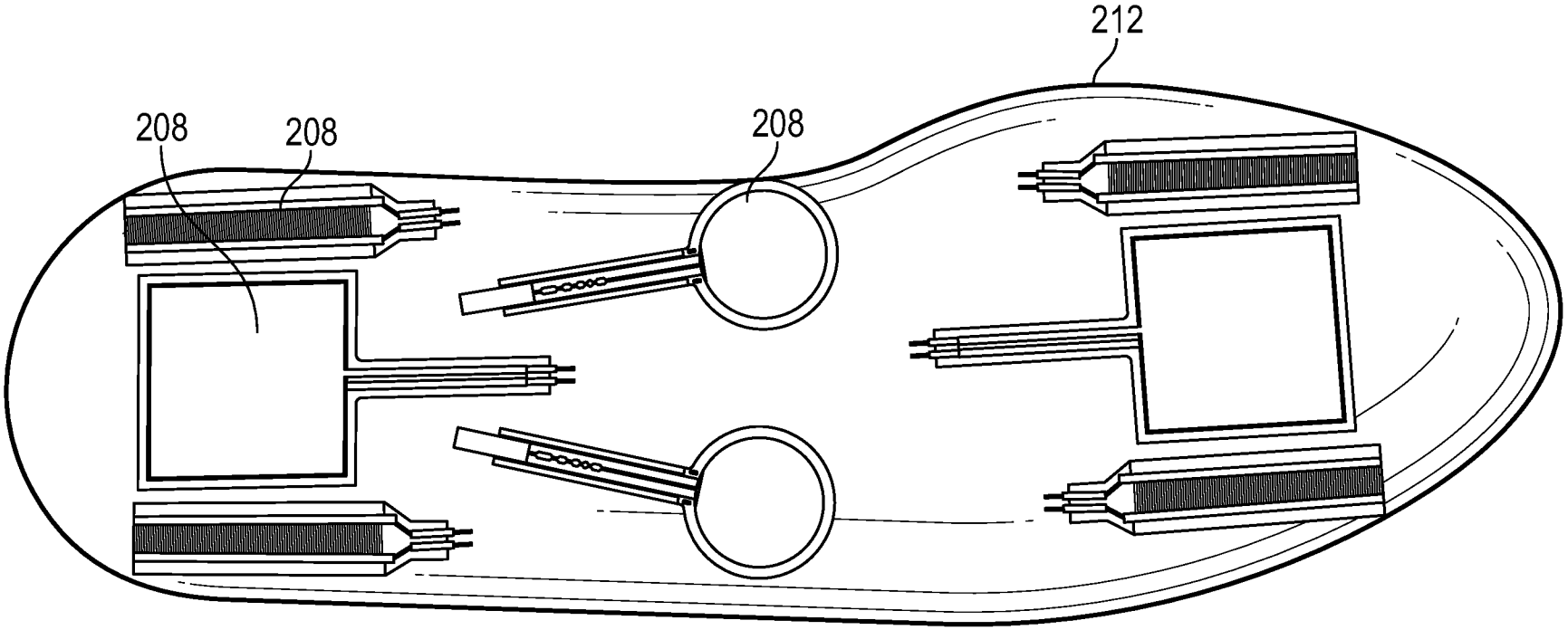
FIG. 10 is a top-down view of a midsole for an article of footwear, including one or more sensors which can be use with the actuation system.

Referring to FIGS. 10 and 11, in addition to, or in lieu of, the sensors 140, 142 and measurement unit 144, rotation of the friction members 104 can be based on output by one or more other sensors, including one or more force sensors 208 and an accelerometer 210. For instance, the force sensors 208 and accelerometer 210 can work in tandem to gather data on the impact pressure and velocity of the user's foot while the user is walking or running. This impact pressure and velocity data can then be used by the friction control system 148 to determine the density of the ground conditions via an impact logic 159. The density of the ground conditions can be correlated with certain textured surfaces 128 and/or coefficients of friction of the friction members 104, which can be used to determine a desired texture surface 128 for the immediate ground surface. Once the friction control system 148 determines the density of the ground conditions, the friction control system 148 can direct the actuator 114 via the impact logic to rotate the friction members 104 to the corresponding textured surface 128 such that the outsole traction is increased or decreased according to the encountered ground surface. As one example, a relatively softer surface will have more give and thereby, will generate less foot impact pressure in comparison to a relatively hard surface at the same foot velocity.

As depicted in FIGS. 10 and 11, the force sensors 208, accelerometer 210, and actuation system 100 can be integrated to form the sole of the footwear 130. Specifically, the force sensors 208 can be coupled to the upper surface and/or integrated within a midsole 212 of the footwear 130 such that the force sensors 208 are in close interface with the foot of the user and bottom portion of the upper portion of the footwear 130. The accelerometer 210 in contrast, can be located within the midsole 212, on the outside of the footwear 130, or the outsole 102 of the actuation system 100, such as shown FIG. 11. As shown in FIG. 10, the force sensors 208 can have a variety of shapes which can be used to cover a wider surface area of the upper surface 214 of the midsole 212. Including a variety of sensors 208 which work in tandem can, for instance, generate with greater accuracy data associated with the foot impact pressure. The shape of each sensor 208 can be based on its respective pressure-resistance (or pressure-conductance) response.

FIG. 11 shows the midsole 212 can be positioned atop the actuation system 100 and the outsole 102 thereof to form the sole of the footwear 130. In this way, the midsole 212 can encase the components of the actuation system 100 within the space between the inner portion 116 of the outsole 102 and the midsole 212. The midsole 212 in this configuration can include one or more recesses and/or cavities along its lower/inner surface to receive the components of the actuation system 100, sensors 208, 210, and/or other components in such a way that the functionality of the actuator is unhindered and protects the actuation system 100 from outside debris. Though described as a midsole, the same principles and features of the present disclosure can be applied to different portions of the sole, including but not limited to, the insole, heel counter support, heel wedge, outsole, etc.

As mentioned above, the friction control system 148 can also be integrated within the sole of the footwear (e.g., as a microcontroller, including a programmable logic device, etc.). This, among other things, can allow the actuation system 100 to function independently of a remote computing device and/or environment during use. This is because the friction control system 148 in this configuration is in direct communication with the force sensors 208, accelerometer 210, and actuator 114, and is operable to analyze the data and direct the actuator 114 accordingly.

In some embodiments, one or more of the algorithms 154-158, including the machine learning algorithm 157, can be used in conjunction with the force sensors 208, accelerometer 210, and impact logic 159 to determine the ground conditions and desired textured surfaces 128. By way of example, the impact pressure and velocity data measured by the force sensors 208 and accelerometer 210 can be used to further train the machine learning algorithm 157 to identify various ground conditions and materials with greater accuracy. In turn, the correlation between the texture surfaces 128 (e.g., and coefficient of friction thereof) and impact pressure and velocity data can be improved, such that the impact logic 159 is capable of recognizing subtle differences in ground conditions and materials via the impact pressure and velocity data, to better determine which textured surfaces 128 are most desirable. In some embodiments, any combination of the algorithms 154-158, impact logic 159, sensors 140, 142, measurement unit 144, force sensors 208, and accelerometer 210, can be used to determine ground conditions and/or rotation of the friction members 104. As an example, the machine learning algorithm 157 can use data output from one or more of the sensors 140, 142 and measurement unit 144 to identify the material of the ground surface, while the impact logic 159, based on the impact pressure and velocity data output from the force sensors 208 and accelerometer 210, can determine which textured surface 128 is most desirable given the identified material.

Figure 12:
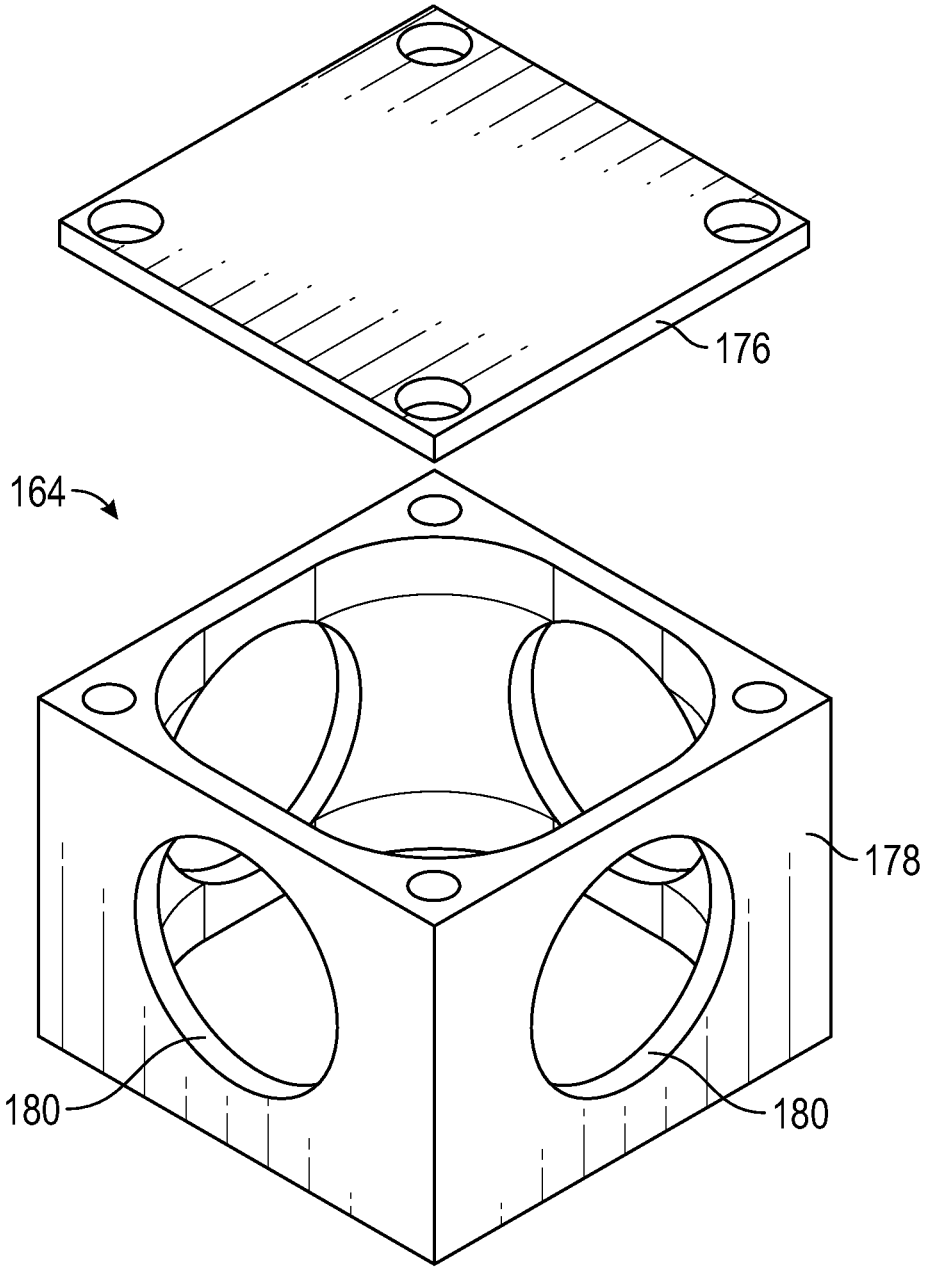
FIG. 12 is a perspective view of a housing for a gear assembly of the actuation system.
Figure 13:
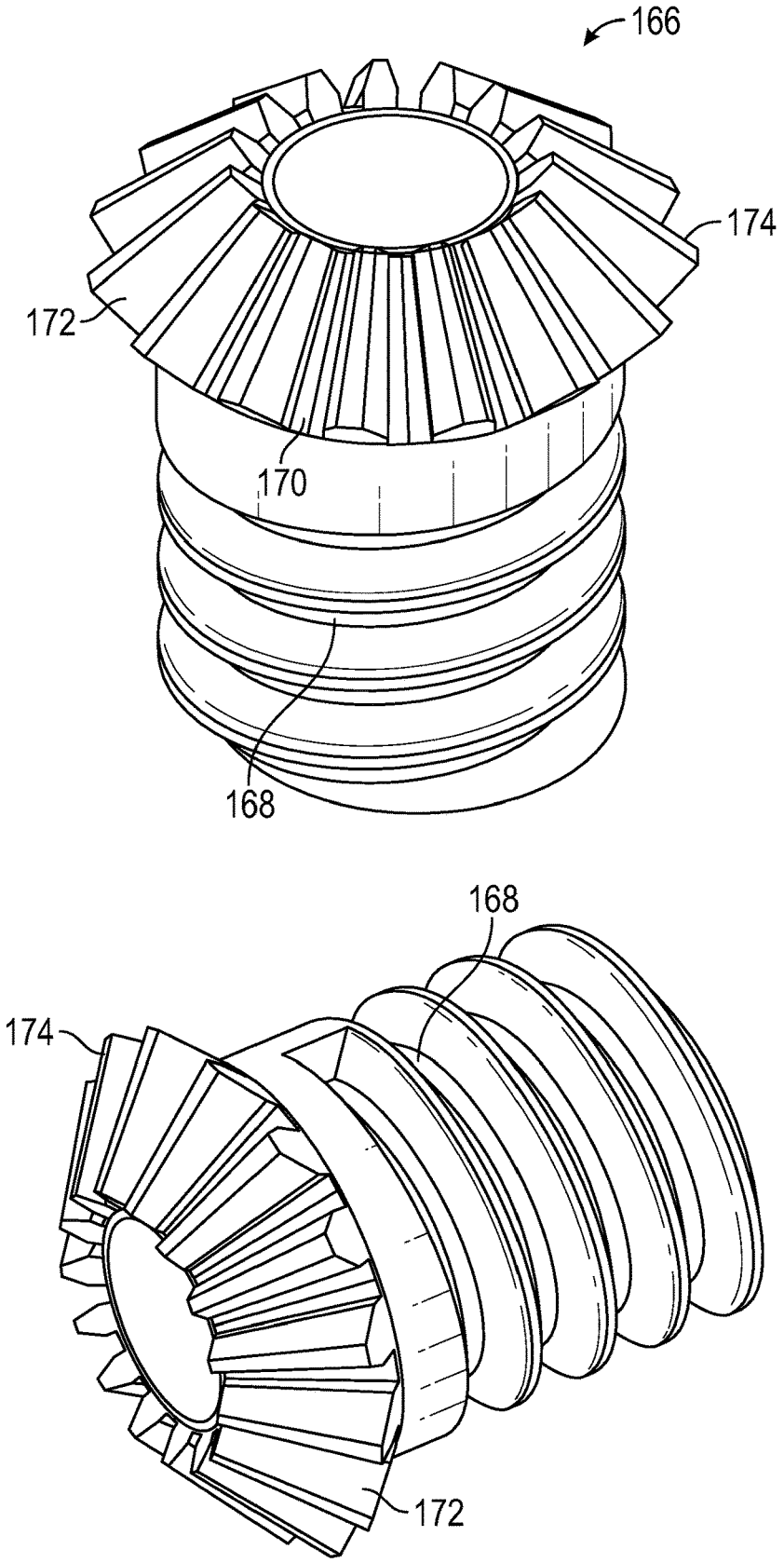
FIG. 13 includes two perspective views of a gear for the gear assembly of the actuation system.

Turning to FIGS. 12-14, the front and rear gear assemblies 108, 110 of the actuation system 100 can include a gearbox 164 and a plurality of gears 166. As shown in FIG. 13, each gear 166 can be configured as a bevel gear, which includes a shaft 168 (e.g., threaded, grooved, etc.) and a tooth-bearing face 170 with a plurality of teeth 174 that forms a conical shape 172. In this way, the tooth-bearing face 170 of each gear 166 is configured to engage and interlock with the tooth-bearing face 170 of one or more adjacent gears 166.

As shown in FIG. 12, each gearbox 164 can include a cover 176 and a housing 178. The housing 178 of each assembly can include multiple sidewall openings 180 that are sized and shaped to receive and retain the gear shafts 168 and are configured in such a way that each gear 166 within the assembly are positioned to engage with one or more adjacent gears 166. For example, FIG. 14 shows four gears 166 retained within the housing 178 and oriented by way of the sidewall openings 180 such that each gear 166 is positioned at a 90-degree angle relative to the two adjacent gears 166. In this arrangement, the teeth 174 of each gear 166 interlock and engage with the recesses formed by the tooth lines of the adjacent gears 166. As such, once a rotational force is applied to one gear 166, each gear 166 of the gear assembly (e.g., assemblies 108, 110) rotates due to the interaction of the interlocking teeth 174 among the gears 166. In this manner, two of the four gears 166 lie along and rotate about a first axis 182 and the other two gears lie along and rotate about a second axis 184, where the first axis 182 and second axis 184 are perpendicular. In some embodiments, the shaft 168 of each of the gears 166 are threaded or include grooves that can help to retain the gears 166 within the sidewall openings 180 of the housing 178. In still further embodiments, the gears 166 can be constructed of variety of different materials, including polymers, aluminum, cast iron, carbon steel, alloy steels, steels.

In embodiments where adjacent gears 166 include an equal number of teeth 174, each gear 166 rotates at the same or substantially same rate, such as in a 1:1 ratio. In other embodiments, the gears 166 can be configured to transmit rotational force in any ratio. For example, any ratio within a range of a 1.5:1 ratio to a 6:1 ratio.

Although the disclosed gear assemblies are described with particularity, it should be appreciated that the gear assemblies and components thereof can be configured in a variety of different ways to achieve the functionality of the embodiments described herein. For instance, the gears need not be bevel gears and/or have straight tooth lines but can rather have different configurations and/or spiraled and/or curved (e.g., zerol bevel gears) tooth lines. In still further embodiments, the gears are contained entirely within the housing, rather than extending outwardly from the housing as described.

Each friction member 104 can be coupled to a respective gear 166 at a connection point 186 via one or more axles 106, such that each friction member 104 is configured to rotate concurrently with its respective gear 166 to adjust the outsole traction. As mentioned, the friction members 104 can be collectively rotated at the same rate. Rotating each of the friction members 104 concurrently and at the same rate can, for example, ensure the desired textured surface 128 of each friction member 104 is within the plane of the outer surface 118 of the outsole 102 when the user's foot contacts the ground surface. In other words, the friction members 104 can be arranged such that each textured surface 128 exposed at the outer surface 118 is the same and can be rotated in sync with one another as the friction members 104 are rotated. In this way, the actuation system 100 can smoothly transition between varying degrees of friction as the user walks or runs about their environment. Moreover, the friction members 104 can be rotated in a clockwise and counterclockwise direction as to minimize the rotation of the friction members 104 as the textured surfaces 128 are changed from a one textured surface to another.

As shown in FIG. 15, the actuation system 100 can include different configurations of axles 106 by which the friction members 104 are coupled to the front and rear gear assemblies 108, 110. As shown in the illustrated embodiment of FIG. 15, the axles can include a relatively longer axle 188, an intermediate axle 190, and a shorter axle 192. Each of the axles 188-192 have a proximal end portion 194 configured to couple (e.g., be received) at a connection point 186 of a respective gear 166 and a distal end portion 196 (e.g., distal the proximal end portion 194) configured to be received by the central opening 126 of the friction members 104 (FIG. 2). As such, the axles 188-192 can be used alone and/or in combination to arrange the friction members 104 around the gear assemblies 108, 110 and in alignment with the openings 120 of the outsole 102.

Figure 5:
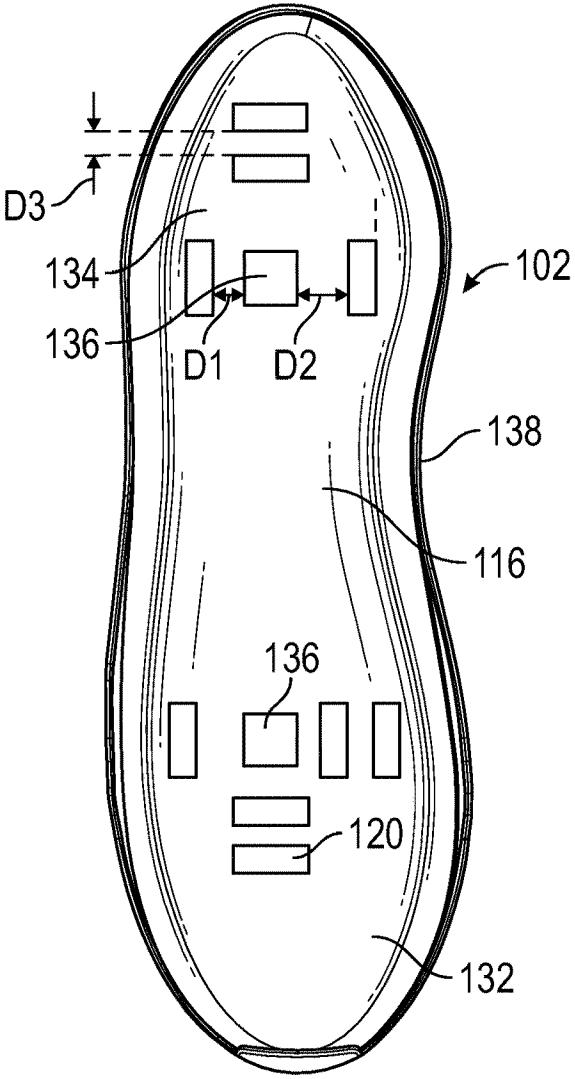
FIG. 5 is a top down view of an outsole of the actuation system.
Figure 6:
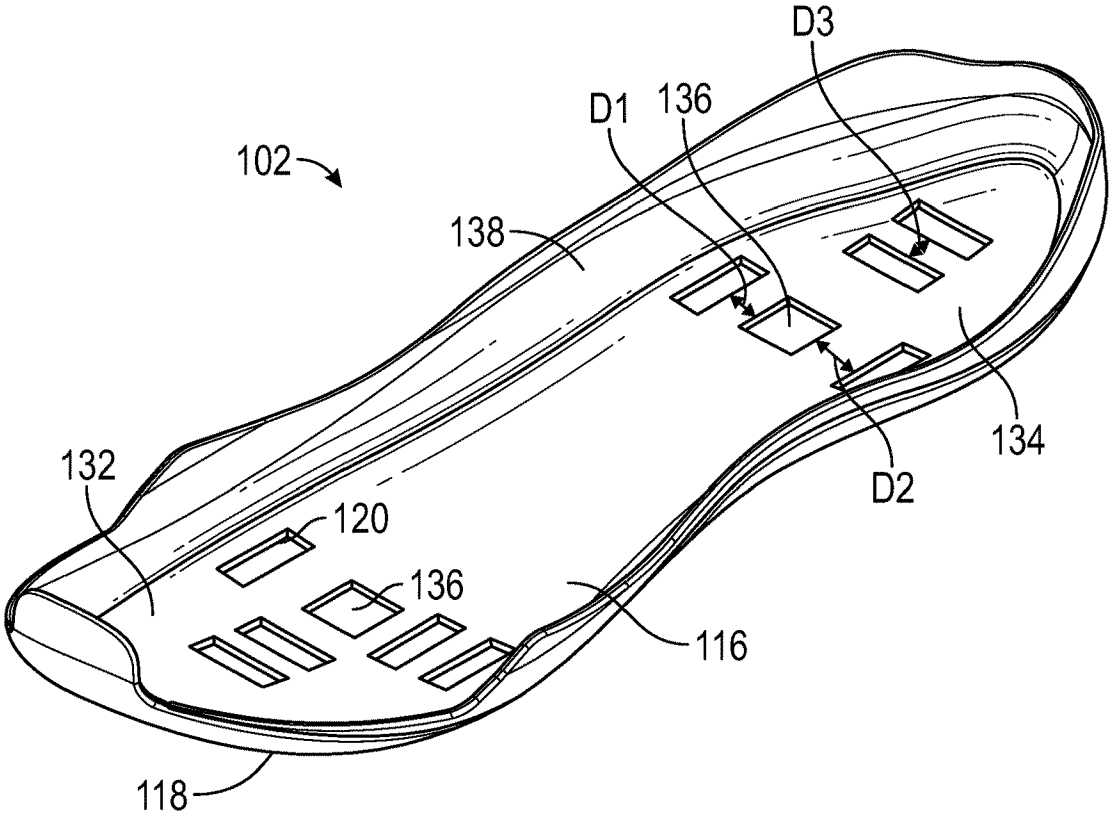
FIG. 6 is a perspective view of the outsole of the actuation system of FIG. 5.

As shown in FIGS. 5 and 6, the longer axles 188 allow the friction members 104 to be situated at a distance D2 from their respective gear assemblies, which is a distance greater than the distance D1 provided by the shorter axles 192. As such, the longer axles 188 can provide further variable traction to more distant, outer portions of the article of footwear 130. For example, in the illustrated embodiment of FIGS. 3 and 5, one or more friction members 104 can be positioned at a distance D2 from the front gear assembly 108 at the front portion 132 of the outsole 102, proximate the toe and the ball of the user's foot. Likewise, one or more friction members 104 can be positioned at a distance D2 from the rear gear assembly 110 at the rear portion 134 of the outsole 102, proximate the heel and below the instep of the footwear. In the same manner, one or more friction members 104 can be positioned closer to the front and gear assemblies 108, 110 at a distance D1 with the shorter axles 192. In some embodiments, the axles 188-192 (and 106 generally) can be sized, shaped, and constructed of various materials to accommodate other configurations.

Additionally and as illustrated in FIG. 15, intermediate axles 192 can be used, for example, to extend the length of the longer and shorter axles 188, 192 and to position two or more consecutive friction members 104 around and proximate to the front and rear gear assemblies 108, 110. For instance, in one example, the distal end portions 196 of the longer and shorter axles 188, 192 can be sized and shaped to receive the intermediate axle 190 (e.g., the proximal and distal end portions 194, 196). In this configuration, the distal end portions 196 of the longer and shorter axles 188, 192 can have a central cavity or recess with a diameter greater than or substantially equal to an outer diameter of the intermediate axles 190, such that the intermediate axle 190 is received. In this manner, a first friction member 104 can be situated at a distance D1 or D2 from a respective gear assembly while a second friction member 104 can be situated at a distance D3 from the distal end of the axle 106 to which the intermediate axle 190 is coupled. For example, a second friction member 104 can be situated from a respective gear assembly at a distance equal to the sum of D3 and the length/distance of the axle of which the intermediate axle 192 is coupled (e.g., D1 or D2). Such as the second outer friction member 104 of each of the three pairs of consecutive friction members 104 shown in FIGS. 1, 3, and 5-6, which are located at the front portion 132 (i.e., two pairs) and rear portion (i.e., one pair) of the outsole 102. In some embodiments, the axles 188-192 can be constructed of various materials, including steel, polymers, ceramics, metals, and/or a combination thereof and can be formed in various sizes, shapes, and/or lengths.

Figure 17:
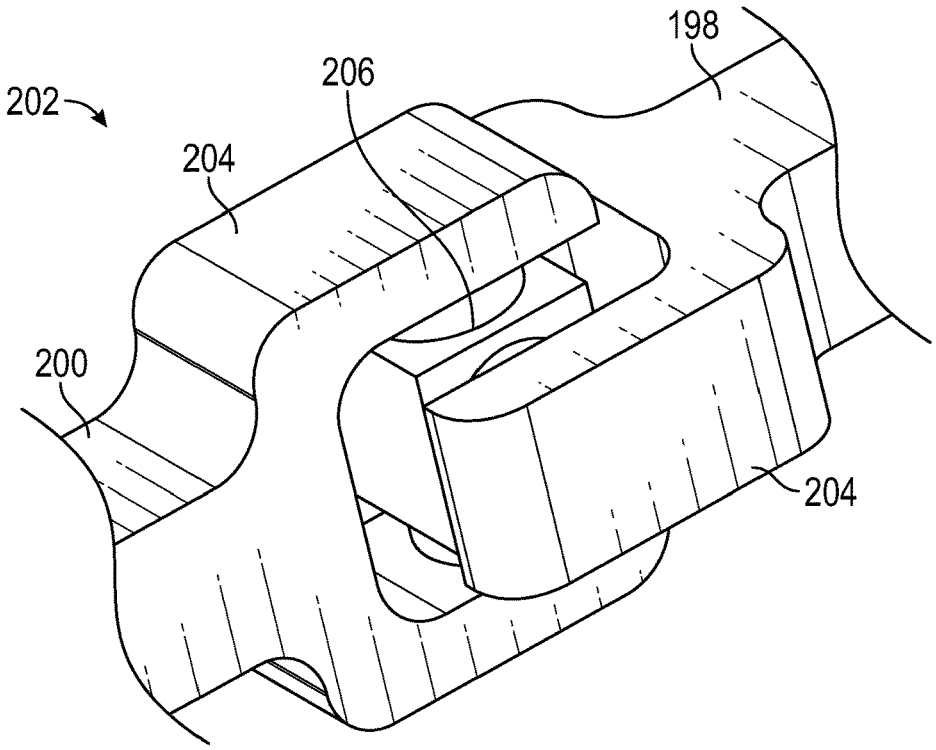
FIG. 17 is a perspective view of a pivotable joint of the crank assembly.
Figure 18:
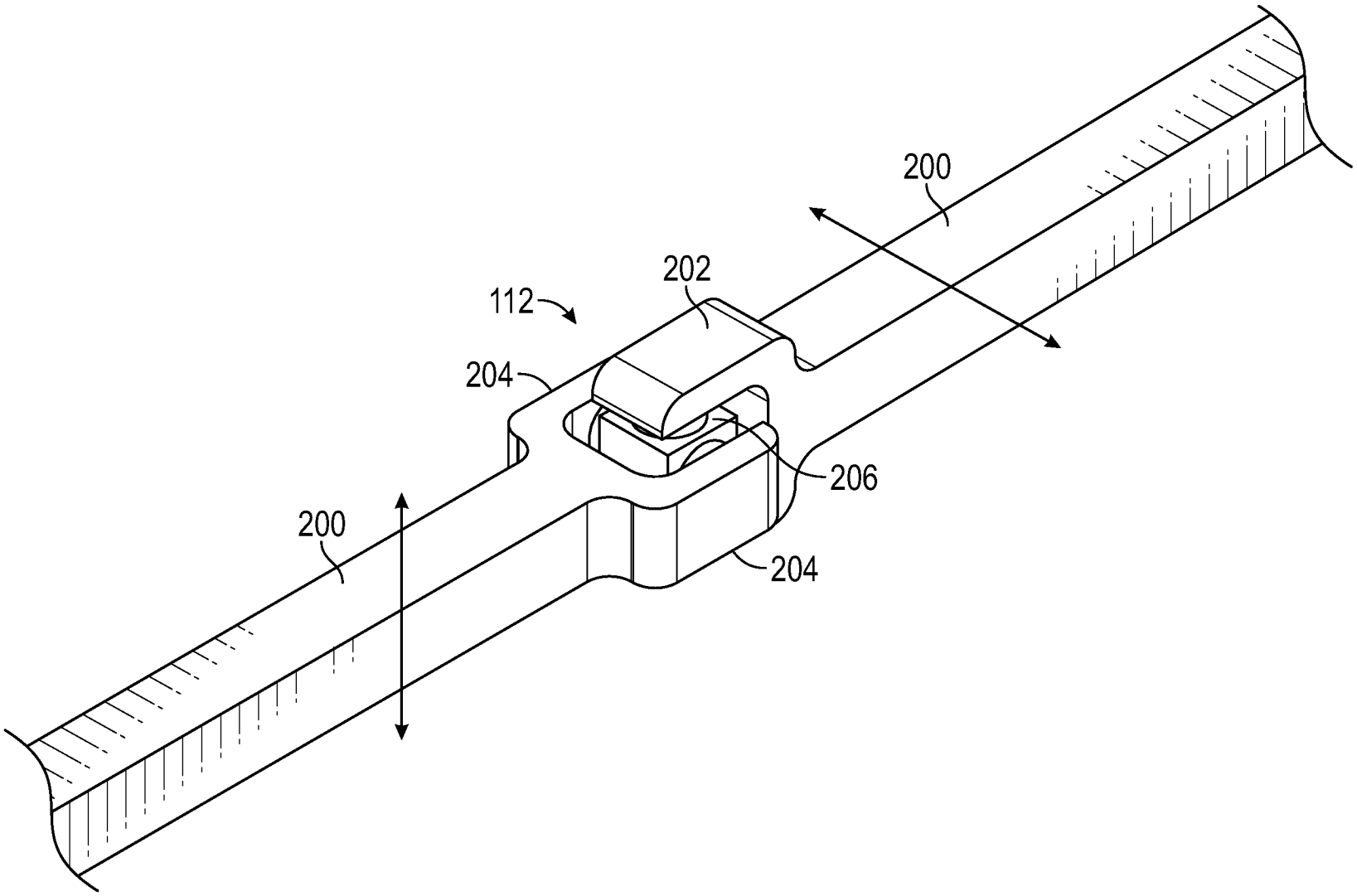
FIG. 18 is a perspective view of the crank assembly.

Now referring to FIGS. 16-18, the actuation system 100 includes one or more crank assemblies 112 that are configured to transmit rotational forces between two or more gear assemblies, such as the front and rear gear assemblies 108, 110. The crank assembly 112 can extend between the two respective gear assemblies and includes two or more shafts 198, 200 coupled together by a series of joints 202 (e.g., a series of universal joints, clevis-pins, etc.). In the illustrated embodiments of FIGS. 16 and 17, a shortened shaft 198 can be coupled to the gear 166 that extends outwardly from the rear gear assembly 110 and directed toward the front gear assembly 108 (e.g., pointed in the direction of the front gear assembly 108). The shortened shaft 168 includes one portion of the joint 202 that couples the shortened shaft 168 to one or more longer shafts 200 (FIG. 18), which extend between the front and rear gear assemblies 108, 110 (FIGS. 1 and 11) and couple to a respective shortened shaft 168 of the front gear assembly 108. The joints 202 coupling the respective shafts 198, 200 can, for example, include a pair of yokes or hinges 204 proximate to and oriented 90 degrees to one another. As such, the pair of hinges 204 can be coupled by a coupling mechanism 206 (e.g., a cross shaft having a central body and four projections) such that the shafts 198, 200 are pivotable relative to one another. In this manner, each shaft 168 of a crank assembly 112 can, for example, pivot to accommodate bending and/or deformation created along the outsole 102 during the stance and swing gait phases, while still allowing rotational movement to be transmitted from one gear assembly to another. In some embodiments, the crank assembly 112 can include any number of shafts 198, 200 and joints 202.

Accordingly, as the actuator 114 applies a rotational force to a friction member 104 and/or axle 106 at the rear most portion 134 of the outsole 102, each of the gears 166 of the rear gear assembly 110 are rotated, transmitting the rotational force to the coupled friction members 104 and the front gear assembly 108 by way of the crank assembly 112. By extension, each gear 166 and friction member 104 coupled to the front gear assembly 108 also rotate. In some embodiments, the actuator 114 applies a rotational force to one or more of the friction members 104 and/or axles 106 of the front gear assembly 108.

Additional Examples of the Disclosed Technology

In view of the above described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1: An actuation system, comprising: a gear assembly having a plurality of gears; a plurality of friction members, each friction member being coupled to a respective gear of the gear assembly and having a series of textured outer surfaces; an outsole for an article of footwear having an inner portion, an outer surface, and a plurality of openings extending from the inner portion to the outer surface, each opening being configured to receive one or more friction members such that at least one textured outer surface of each friction member is exposed on the outer surface of the outsole; and an actuator configured to rotate one or more gears of the gear assembly such that each friction member rotates relative to the outsole.

Example 2: The actuation system of any example herein, particularly example 1, wherein each friction member has the same series of textured outer surfaces, and wherein two or more of the textured outer surfaces of the series have a different coefficient of friction.

Example 3: The actuation system of any example herein, particularly any one of examples 1-2, wherein each textured outer surface has a distinct design pattern.

Example 4: The actuation system of any example herein, particularly any one of examples 1-3, wherein the series of textured outer surfaces comprises two or more textured outer surfaces repeated in an alternating sequence.

Example 5: The actuation system of any example herein, particularly any one of examples 1-4, wherein each friction member is arranged within its respective opening such that each textured outer surface exposed on the outer surface of the outsole is the same.

Example 6: The actuation system of any example herein, particularly any one of examples 1-5, wherein the gear assembly, the friction members, and the actuator are housed within the inner portion of the outsole.

Example 7: The actuation system of any example herein, particularly any one of examples 1-6, wherein the outsole is integrated with an article of footwear.

Example 8: The actuation system of any example herein, particularly any one of examples 1-6, wherein the outsole is configured to couple to an article of footwear Example 9: The actuation system of any example herein, particularly any one of examples 1-8, wherein each friction member has six or more textured outer surfaces.

Example 10: The actuation system of any example herein, particularly any one of examples 1-8, wherein each friction member has two or more textured outer surfaces.

Example 11: The actuation system of any example herein, particularly any one of examples 1-10, wherein the friction members rotate at the same rate of rotation.

Example 12: The actuation system of any example herein, particularly any one of examples 1-11, wherein the actuator rotates the friction members based on data from one or more sensors and/or measurement units.

Example 13: The actuation system of any example herein, particularly any one of examples 1-12, wherein the actuator rotates the friction members based on output from a friction control system.

Example 14: The actuation system of any example herein, particularly any one of examples 1-13, wherein the gear assembly comprises four gears, two of the four gears lying along and rotating about a first axis and the other two gears lying along and rotating about a second axis perpendicular to the first axis.

Example 15: The actuation system of any example herein, particularly any one of examples 1-14, wherein two or more friction members are positioned parallel to one another.

Example 16: An actuation system comprising: a pair of gear assemblies, each gear assembly having a plurality of gears configured to interlock and rotate with one or more adjacent gears; a crank assembly having a series of shafts coupled at one end to a respective gear of one gear assembly and coupled at the outer end to a respective gear of the second gear assembly such that the crank assembly extends between the pair of gear assemblies; a plurality of friction members, each friction member being coupled to a respective gear of one of the gear assemblies and having a series of textured outer surfaces; an outsole for an article of footwear having an inner portion, an outer surface, and a plurality of openings extending from the inner portion to the outer surface, each opening receiving one or more of the friction members such that at least one of the textured outer surfaces of each friction member partially extends beyond or substantially lies within a plane of the outer surface of the outsole; and an actuator configured to rotate one or more gears of one of the gear assemblies such that each friction member coupled to each gear assembly rotates relative to the outsole.

Example 17: The actuation system of any example herein, particularly example 16, wherein adjacent shafts of the crank assembly are pivotably coupled to one another by a pivotable joint such that each shaft is pivotable relative to the other.

Example 18: The actuation system of any example herein, particularly any one of examples 16-17, wherein the crank assembly is configured to transmit rotational motion between the pair of gear assemblies such that the crank assembly, the gears of each gear assembly, and the friction members rotate concurrently.

Example 19: The actuation system of claim any example herein, particularly example 16, wherein each joint is a universal joint.

Example 20: The actuation system of any example herein, particularly any one of examples 16-19, wherein two or more friction members are coaxially aligned and coupled to one another.

Example 21: An actuation system comprising: an actuator; a friction member coupled to the actuator and having a series of textured outer surfaces; and an outsole for an article of footwear having an outer surface and an opening configured to receive the friction member and expose at least one textured outer surface of the friction member on the outer surface of the outsole; wherein the actuator is configured to rotate the friction members based on data from one or more sensors such that the textured outer surface exposed on the outer surface of the outsole is rotated to a different textured outer surface.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An actuation system, comprising:

a gear assembly having a plurality of gears;

a plurality of friction members, each friction member being coupled to a respective gear of the gear assembly and having a series of textured outer surfaces;

an outsole for an article of footwear having an inner portion, an outer surface, and a plurality of openings extending from the inner portion to the outer surface, each opening being configured to receive one or more of the friction members such that at least one textured outer surface of each friction member is exposed on the outer surface of the outsole; and an actuator configured to rotate one or more gears of the gear assembly such that each friction member rotates relative to the outsole, wherein the series of textured outer surfaces comprises two or more textured outer surfaces and rotation of a respective one of the plurality of friction members by the actuator causes one of the two or more textured outer surfaces to be exposed on the outer surface of the outsole.

2. The actuation system of claim 1, wherein each friction member has the same series of textured outer surfaces, and wherein the two or more of the textured outer surfaces of the series have a different coefficient of friction.

3. The actuation system of claim 1, wherein each textured outer surface has a distinct design pattern.

4. The actuation system of claim 1, wherein the two or more textured outer surfaces are repeated in an alternating sequence.

5. The actuation system of claim 1, wherein each friction member is arranged within its respective opening such that each textured outer surface exposed on the outer surface of the outsole is the same.

6. The actuation system of claim 1, wherein the gear assembly, the friction members, and the actuator are housed within the inner portion of the outsole.

7. The actuation system of claim 1, wherein the outsole is integrated with an article of footwear.

8. The actuation system of claim 1 wherein the outsole is configured to couple to an article of footwear.

9. The actuation system of claim 1, wherein each friction member has six or more textured outer surfaces.

10. The actuation system of claim 1, wherein the friction members rotate at the same rate of rotation.

11. The actuation system of claim 1, wherein the actuator rotates the friction members based on data from one or more sensors and/or measurement units.

12. The actuation system of claim 1, wherein the actuator rotates the friction members based on output from a friction control system.

13. The actuation system of claim 12, wherein the friction control system comprises one or more sensors to analyze and detect a type of ground surface and cause the actuator to change the textured outer surface to increase or decrease traction between the article of footwear and the ground surface based on the detected type of ground surface.

14. The actuation system of claim 12, wherein the friction control system comprises one or more force sensors or accelerometers to gather data on impact pressure and velocity of a user's foot while walking or running and cause the actuator to change the textured outer surface to increase or decrease traction between the article of footwear and a ground surface based on the gathered data.

15. The actuation system of claim 1, wherein the plurality of gears comprises four gears, two of the four gears lying along and rotating about a first axis and the other two gears lying along and rotating about a second axis perpendicular to the first axis.

16. The actuation system of claim 1, wherein two or more of the friction members are positioned parallel to one another.

17. An actuation system comprising:

a pair of gear assemblies, each gear assembly having a plurality of gears configured to interlock and rotate with one or more adjacent gears;

a crank assembly having a series of shafts, wherein the crank assembly is coupled at one end of the crank assembly to a respective gear of one of the pair of gear assemblies and coupled at an opposing end of the crank assembly to a respective gear of the other gear assembly of the pair of gear assemblies such that the crank assembly extends between the pair of gear assemblies;

a plurality of friction members, each friction member being coupled to a respective gear of one of the gear assemblies and having a series of textured outer surfaces;

an outsole for an article of footwear having an inner portion, an outer surface, and a plurality of openings extending from the inner portion to the outer surface, each opening receiving one or more of the friction members such that at least one of the textured outer surfaces of each friction member partially extends beyond or substantially lies within a plane of the outer surface of the outsole; and an actuator configured to rotate one or more gears of at least one of the pair of gear assemblies such that each friction member coupled to each gear assembly rotates relative to the outsole.

18. The actuation system of claim 17, wherein adjacent shafts of the crank assembly are pivotably coupled to one another by a pivotable joint such that each shaft is pivotable relative to the other.

19. The actuation system of claim 18, wherein each joint is a universal joint.

20. The actuation system of claim 17, wherein the crank assembly is configured to transmit rotational motion between the pair of gear assemblies such that the crank assembly, the gears of each gear assembly, and the friction members rotate concurrently.

21. The actuation system of claim 17, wherein two or more friction members are coaxially aligned and coupled to one another.

22. An actuation system, comprising:

a gear assembly having a plurality of gears;

a plurality of friction members, each friction member being coupled to a respective gear of the gear assembly and having a series of textured outer surfaces;

an outsole for an article of footwear having an inner portion, an outer surface, and a plurality of openings extending from the inner portion to the outer surface, each opening being configured to receive one or more of the friction members such that at least one textured outer surface of each friction member is exposed on the outer surface of the outsole; and an actuator configured to rotate one or more gears of the gear assembly such that each friction member rotates relative to the outsole, wherein the plurality of gears comprises four gears, two of the four gears lying along and rotating about a first axis and the other two gears lying along and rotating about a second axis perpendicular to the first axis.

* * * * *